United States Patent [19]

Arakawa

[11] Patent Number: 4,491,905

[45] Date of Patent: Jan. 1, 1985

[54] METHOD FOR DRIVING A MOTOR USED IN A LOOM

[75] Inventor: Akio Arakawa, Kariya, Japan

[73] Assignee: Kabushiki Kaisha Toyoda Jidoshokki Seisakusho, Aichi, Japan

[21] Appl. No.: 368,029

[22] Filed: Apr. 13, 1982

[30] Foreign Application Priority Data

Apr. 18, 1981 [JP] Japan ..... 56-057823

[51] Int. Cl.[3] ..... H02K 29/04; D03D 47/00

[52] U.S. Cl. ..... 364/181; 364/130; 364/184; 318/446; 318/386; 318/563

[58] Field of Search ..... 318/446, 386, 685, 696, 318/563; 364/130, 167, 174, 181, 171, 184

[56] References Cited

U.S. PATENT DOCUMENTS

| | | | |
|---|---|---|---|
| 2,884,016 | 4/1959 | Sanderson et al. | 139/336 |
| 3,838,258 | 9/1974 | Logan | 364/130 X |
| 4,241,400 | 12/1980 | Kiefer | 307/141 X |
| 4,288,705 | 9/1981 | Barske | 307/142 X |
| 4,298,946 | 11/1981 | Hartsell et al. | 364/181 X |
| 4,371,822 | 2/1983 | Otsuka et al. | 318/696 |
| 4,381,459 | 4/1983 | Cotton | 307/139 |
| 4,398,568 | 8/1983 | Rydborn | 139/1 R |
| 4,412,562 | 12/1983 | Kobayashi et al. | 139/353 X |

FOREIGN PATENT DOCUMENTS

| | | |
|---|---|---|
| 1535709 | 9/1969 | Fed. Rep. of Germany . |
| 388870 | 6/1965 | Switzerland . |
| 630401 | 10/1949 | United Kingdom . |

*Primary Examiner*—Jerry Smith
*Assistant Examiner*—Allen MacDonald

[57] ABSTRACT

An arrangement to preclude false starting and stopping of a motor driving a loom in accordance with start and stop control signals from a microprocessor control unit susceptible to noise. The motor is connected to start only upon coincidence between the control unit start signal and energization of a manually operated start switch; and to stop in response to either the control unit stop signal or energization of a manually operated stop switch.

9 Claims, 3 Drawing Figures

METHOD FOR DRIVING A MOTOR USED IN A LOOM

The present invention relates to a method for driving a motor used in a loom directly controlled by a microcomputer.

Microcomputers have come into increasingly wider use in recent years. Now, they are even used for the direct control of looms. Use of microcomputers for direct control of looms has such advantages as the following:

1. Prevention of inferior production due to misoperation or motion stopping trouble.

2. Improvement of ability to detect abnormalities or trouble in the loom control system and facilitation of maintenance.

3. Diversification of specifications and greater freedom of specification modifications through microcomputer programs.

However, on the other hand, once the microcomputer malfunctions, not only will the above-mentioned advantages not be obtained, but also there is the danger of run-away loom operation. Accordingly, prevention of microcomputer malfunctions is crucial. Such malfunctions, of course, would seriously impede normal loom operation. They would, however, be of critical damage if relating to the motor driving the whole loom. Such malfunctions include the erroneous issuance of a start command from the microcomputer to the motor at times the motor should not be driven or, conversely, the failure to issue a stop command from the microcomputer to the running motor at times the motor should be stopped.

Therefore, it is an object of the present invention to provide a method for driving a motor used in a loom, which is fail-safe against erroneous commands supplied from microcomputers.

The present invention will be more apparent from the ensuing description with reference to the accompanying drawings, wherein.

Figure 1:
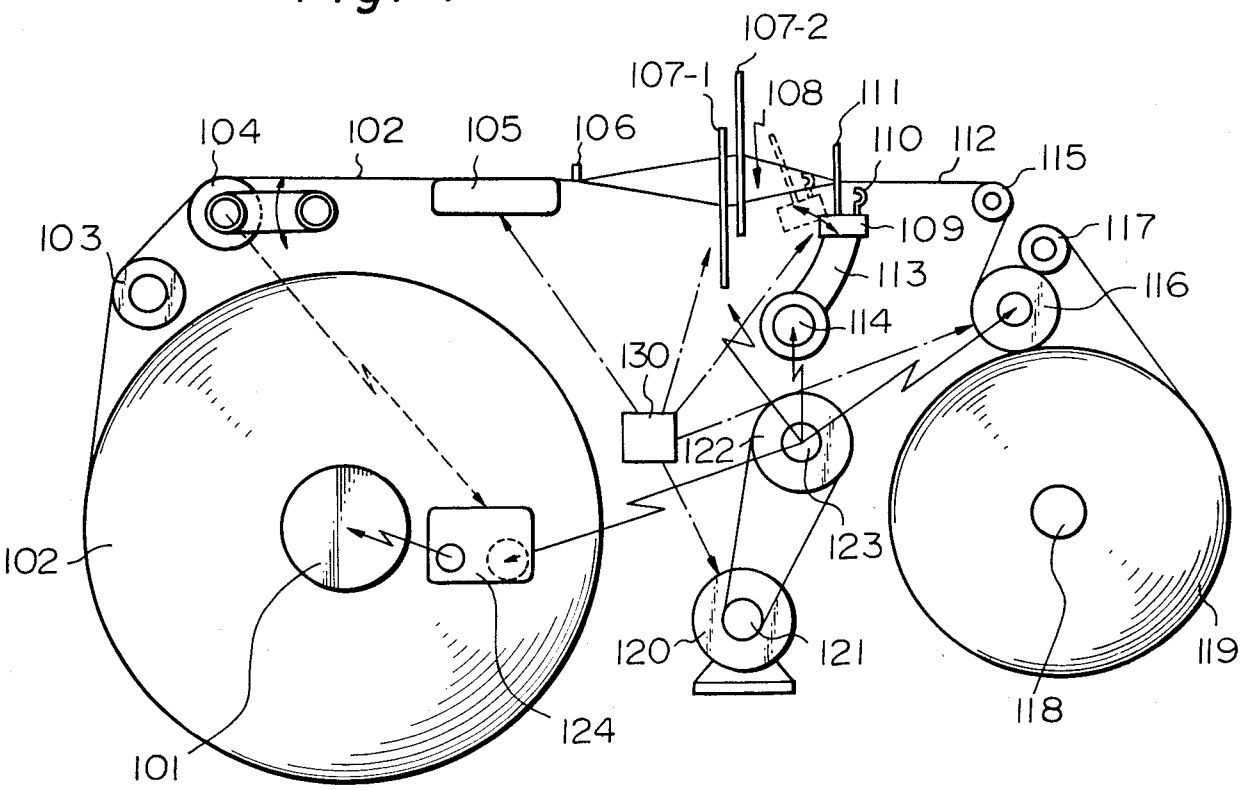
FIG. 1 is a schematic whole view of a typical construction of the loom to which the present invention is applied.

FIG. 1 is a schematic whole view of a typical construction of the loom to which the present invention is applied. In FIG. 1, the reference numeral 101 indicates a yarn beam. The yarn beam has wrapped around it in parallel a great number of warp yarns 102. The warp yarns 102 are led via a back roller 103 and a tension roller 104 to a warp stop motion unit 105. The warp stop motion unit 105 contains droppers (not shown) for each warp yarn. If any warp yarn breaks or comes to its end, the corresponding dropper detects this and starts an operation to stop the running of the frame. The warp yarns 102 pass through the warp stop motion unit 105, and while pressed by means of a presser bar 106, are alternatively divided up and down into two groups by heald frames 107-1 and 107-2, thereby forming an opening 108 between the divided warp yarns. A weft yarn is inserted at very high speed into the opening 108 by means of a weft yarn feeder (not shown), for example, an air-jet nozzle. The insertion is guided by a sley 109 mounting a picking quide 110. The sley 109 is also provided with reeds 111. The reeds 111, through the swing motion of the sley 109, beat the weft yarn rightward in FIG. 1 with each insertion of weft yarn into the opening 108 to produce woven fabrics 112. The above-mentioned swing motion of the sley 109 is provided via a sley sword 113 by a rocking shaft 114.

The woven fabrics 112 pass via a brest beam 115, surface roller 116, and a press roller 117 and are wound around winding roller 118. Reference numeral 119 indicates the wound woven fabrics.

The power for the above-mentioned operations is provided by a motor 120. The rotational driving power of the motor 120 is transmitted via a motor pulley 121 to a driving pulley 122 thereby to turn a crankshaft 123. The rotational driving power is fed to predetermined units along the jagged arrows (FIG. 1). The yarn beam 101 receives the rotational driving power by way of a transmission 124. The transmission 124 is supplied with a feedback signal from the tension roller 104 along the dotted jagged arrow. The feedback signal is effective for maintaining suitable tension on the warp yarns 102.

The present invention assumes that the loom is directly controlled and completely managed in operation by a microcomputer. The microcomputer is schematically represented by a block having the reference numeral 130. The microcomputer 130 communicates with the other mechanisms as schematically indicated by the chain dotted arrows. (In practice, communication is effected by signal lines connected to the microcomputer 130 at its various I/O ports (input/output ports).)

As understood from FIG. 1, the microcomputer 130 is the center of operation of each mechanism in the loom. Microcomputer malfunctions must therefore be prevented. This is especially true of malfunctions relating to the motor 120, as the motor 120 supplies the driving power for the entire loom. A sufficiently fail-safe method must be established for the starting or stopping of the motor 120. Microcomputers, however, are generally very susceptible to electric noise and the like. This makes the establishment of a completely fail-safe method based on only the microcomputer per se impossible.

It is therefore necessary to base the fail-safe method also on the motor 120 assuming a microcomputer malfunction.

Figure 2:
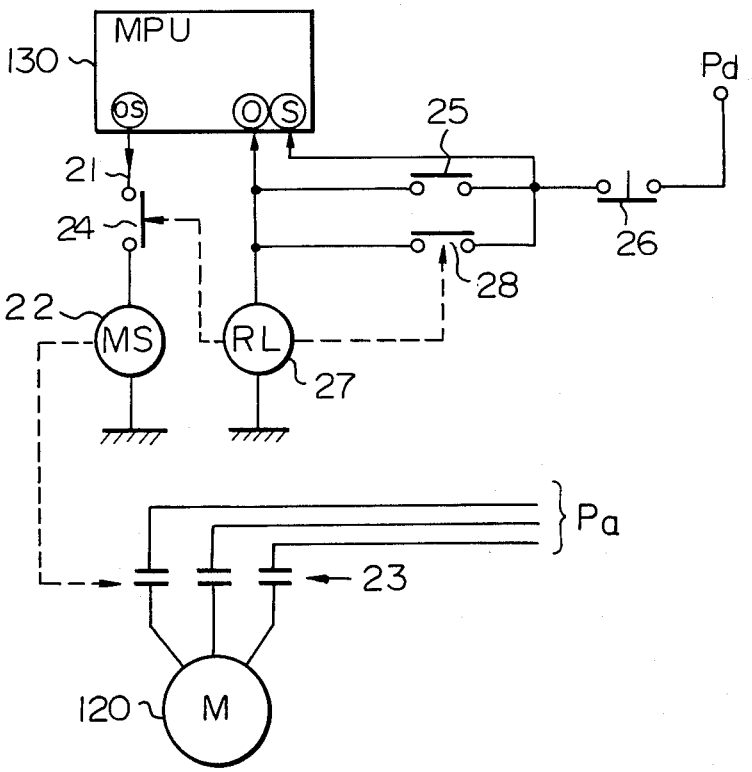
FIG. 2 is a schematic view briefly illustrating one example of hardware for putting the method of the present invention into practice.

FIG. 2 is a schematic view illustrating one example of hardware briefly for putting the method of the present invention into practice. In FIG. 2, reference numeral 130 represents, as previously mentioned, the microcomputer (MPU: microprocessor unit). Reference numeral 120 represents the aforementioned motor. The microcomputer 130 issues commands to start or stop the motor (M) 120 from I/O port (OS) to signal line 21. This either energizes or de-energizes a circuit means for controlling the motor 120 comprising a magnet switch (MS) 22, thereby closing or opening a contactor 23 and starting or cutting off the supply of an electric power source, for example, a three-phase AC power source $P_a$, to the motor 120. In just the above arrangement of hardware (i.e., without switch 24, mentioned later), the aforesaid start or stop command is directly issued to the motor 120. Under such an arrangement, if the microcomputer erroneously issues a command to start the motor 120, the motor 120 will erroneously start rotating at a time it should not operate. Contrary to the above, if the microcomputer fails to issue a command to stop the motor 120, the motor 120 will erroneously continue to rotate at a time it must suddenly be stopped. According to the present invention, however, there is further provided pushbutton switches 25 and 26. When initially starting up the motor 120, the pushbutton switch 25 is placed ON to apply the operation input signal to the operation-input port Ⓞ of the microcomputer 130. The power of the operation input signal is supplied by, for example, a DC power source $P_d$. When desiring to finally stop the motor 120, the pushbutton switch 26 is placed OFF to apply a stop input signal to the stop-input port Ⓢ of the microcomputer 130.

According to the present invention, there is still further provided a switch 24 inserted in series in the signal line 21. The switch 24 is not under the control of the microcomputer 130, but is subject to manual operation by an operator. With such an arrangement, even if a command for starting the motor is erroneously issued from I/O port OS (i.e., at stage where motor must not be operated), the erroneous command will not act on the motor 120 since the switch 24 would then be OFF. The switch 24 comprises, for example, one contact of a relay (RL) 27. The relay 27 is not energized and its contacts remain OFF so long as the pushbutton switch 25 is not manually turned ON, that is, so long as the operation-input signal is not supplied to the operation-input port Ⓞ. Once the switch 25 is turned ON, the relay 27 is energized and, at the same time, is self-sustained by its other contact 28.

While the contact 28 is self-sustained (conductive) and the switch 24 is held ON by the energization of the relay 27, the motor 120 will continue to rotate. In such a state, if the microcomputer 130 fails to issue a command to stop the motor 120 to the signal line 21 during a sequence calling for the motor 120 to be suddenly stopped, the motor 120 will still continue rotating. In such cases, the operator can manually place the pushbutton switch 26 OFF. This would release the self-sustainment, by the contact 28 of the relay 27, de-energized the relay 27, and terminate the erroneous operation command. This therefore constitutes an start-stop interlock with the motor 120.

FIG. 2 is provided only for explaining the basic concept of the present invention.

Figure 3:
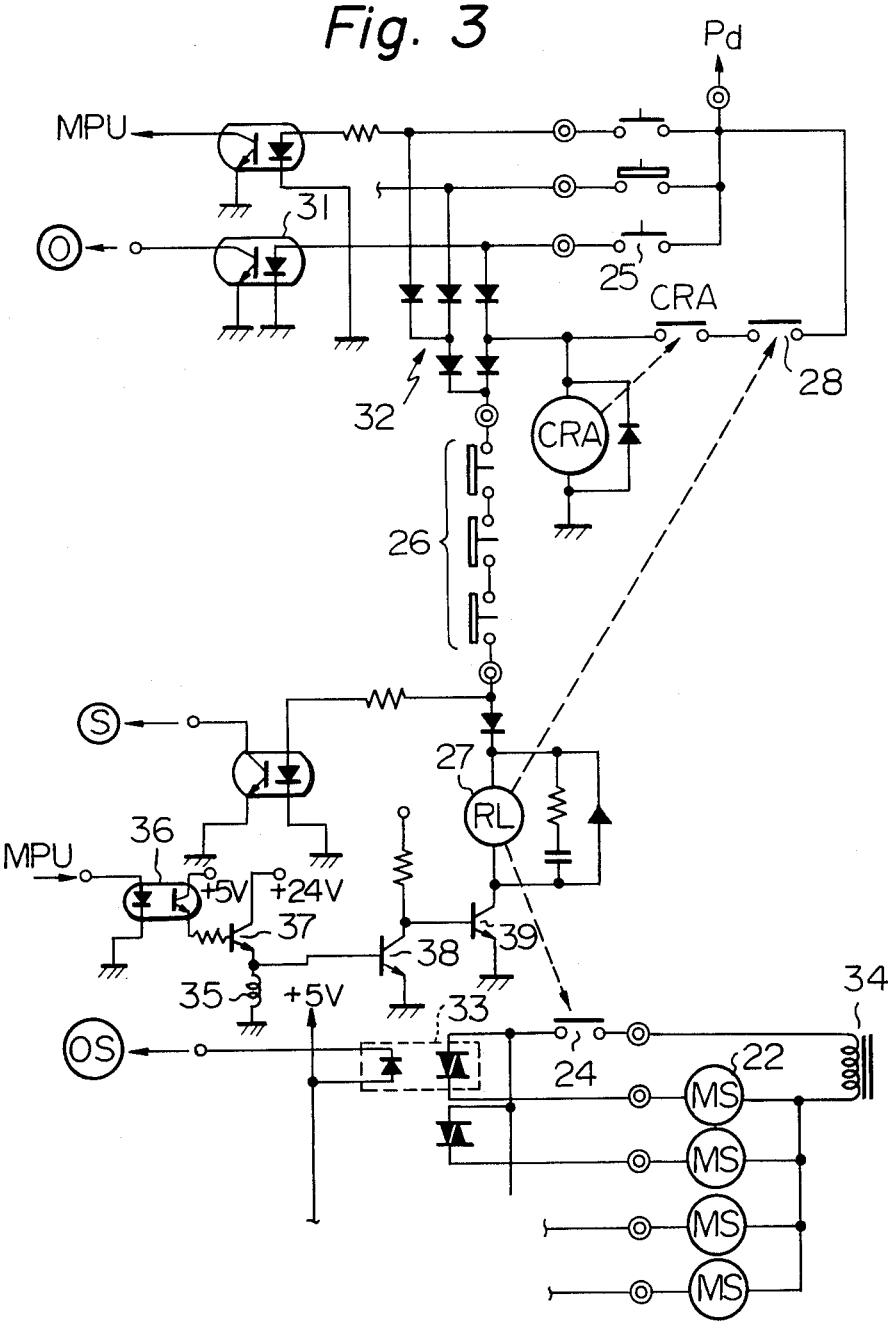
FIG. 3 is a circuit diagram of one example of an arrangement for actually constructing the hardware shown in FIG. 2.

FIG. 3 is a circuit diagram of one example of an arrangement for actually constructing the hardware shown in FIG. 2. It should be understood that FIG. 3 also illustrates portions not based on the present invention. Only portions based on the present invention have reference numerals or symbols. Further, in this figure, members identical to those of FIG. 2 have the same reference numerals or symbols as those of FIG. 2. In FIG. 3, depression of the pushbutton switch 25 is, on one hand, communicated, via photoisolator 31 to the operation-input port Ⓞ of the microcomputer and, on the other hand, energizes the relay 27, via a backflow prevention diode 32 and motor-stop pushbutton switch 26 (comprising, in consideration of work efficiency, three independent switches so as to be able to be operated at any one of three places). This places the switch 24 ON. At this time, a simultaneous command to start the motor from the output port OS of the microcomputer would turn a triac switch 33 having a photoisolator ON and supply output voltage from a transformer 34 to a magnetic switch 22. The then energized switch 22 would then close its contactor 23 (FIG. 2) and start the motor 120 (FIG. 2) operating. At this time, the relay 27 is self-sustained by means of its contact 28.

Next, when the command from the output port OS of the microcomputer should be stopped and the switch 33 should be turned OFF so as to stop the motor 120, if the switch 33 is erroneously left ON, the operator can manually place the pushbutton switch 26 OFF to de-energize the relay 27 and forcibly place the switch 24 OFF.

The above explanation was made regarding the relation between the motor and the manual operation however, there are also cases where the loom must be stopped other than by manual pushbutton switch operation, for example, with warp or weft yarn breakage. In such cases, the microcomputer issues a command to stop the motor 120, a brake is applied, and the frame comes to a stop. The brake may be, for example, an electromagnetic brake (reference numeral 35 in FIG. 3). Brake 35 may, for example, be directly connected to the primary shaft of the motor (reference numeral 120 in FIGS. 1 and 2). The microcomputer (MPU) 130 operates the brake 35 via a photoisolator 36 and a transistor 37 (FIG. 3). If some trouble (for example, breakage of weft yarn) occurs, the microcomputer 130 receives from a weft yarn breakage sensor (feeler mechanism) a signal requesting the motor be stopped. In response to that signal, the microcomputer (MPU) 130 operates the above-mentioned brake (electromagnetic brake 35) via the photoisolator 36 and the transistor 37 (FIG. 3). In this case, since the motor is not stopped by the pushbutton switch 26, the relay 27 is not cut off from the power source and is still self-sustained. This means that the aforesaid start-stop interlock with the motor can no longer be attained. This problem can be resolved by employing, for the relay 27, an additional interlock circuit comprising transistors 38 and 39 driven by partially branched output from transistor 37. When the transistor 37 is turned ON and the brake is operated, transistor 38 is turned ON and transistor 39 is turned OFF, thereby deenergizing the relay 27. That is, the self-sustainment of the relay 27 is released, thus reobtaining the aforementioned start-stop interlock. As apparent from the above, since the additional interlock circuit, driven by the braking output, cooperates with the relay 27, an interlock for the relay 27 can also be created in cases other than manual pushbutton switch, every time the loom must stop its operation. The additional interlock circuit is also effective for creating an interlock between the brake and the motor. That is, the motor cannot be started when the brake is operated. Further, if the motor is already operating operation of the brake will automatically stop that motor operation without a stop command. It is, of course, possible to de-energize the relay 27, every time the frame stops, through commands from another microcomputer and regardless of the aforementioned braking operation.

As mentioned above, according to the present invention, an interlock between at least the microcomputer and manual operation can be created with regard to the start and stop of the motor, and, accordingly, a loom having a high degree of reliability can be realized.

I claim:

1. A method for driving a motor which responds to start and stop signals generated on a signal line by a microcomputer to operate a loom, said method comprising the steps of:

providing a first manually controllable switch comprising contacts of a relay in series with said signal line;

starting the motor when there is coincidence between a command issued from the microcomputer to start the motor and a manual operation causing energization of said first switch to start the motor;

stopping the motor when at least one of a command issued from the microcomputer to stop the motor and a manual operation causing de-energization of said first switch to stop the motor is performed; and turning said first switch ON and OFF by energizing and de-energizing the relay via a manually operable second switch and a third switch connected in series, the third switch comprising another contact of the relay and being self-sustained once the relay is energized from the power source.

2. A method as set forth in claim 1, comprising the additional steps of connecting an interlock circuit in series with the second switch, the third switch, and the relay, and causing a command to be issued from the microcomputer to turn off the interlock circuit to stop the loom and effect a braking operation on the motor.

3. A method for driving a motor which responds to start and stop signals generated on a signal line by a microcomputer to operate a loom, said method comprising the steps of:

starting said motor only when said start signal is generated in coincidence with the energization of a manually controlled start switch in series with said signal line;

thereafter maintaining the energization of said manually controlled start switch;

stopping said motor in response to either said stop signal or the energization of a manually controlled stop switch; and de-energizing said manually controlled start switch to interrupt said signal line in response to the energization of said manually controlled stop switch.

4. A method as set forth in claim 3, wherein the commands to start and stop the motor are issued to start and stop a weaving operation of the loom, comprising the additional step of issuing a command to stop the motor when an abnormality, such as breakage of yarn, occurs in the loom.

5. A method for driving a motor used in a loom deriving driving power necessary for its operation from a motor, said motor being controlled by a microcomputer having at least one input/output port, said method comprising the steps of, (a) turning on a start switch by a manual operation, when said motor is to be started, to provide an operation-input signal to said microcomputer;

(b) energizing a coincidence switch in response to the turning on of the start switch, to enable a command issued from said microcomputer in response to said operation-input signal, to be provided via said start switch to start said motor;

(c) turning off a stop switch by a manual operation, when said motor is to be stopped, to cause a stop input signal to be applied to said microcomputer; and (d) turning said coincidence switch off in response to the turning off of the stop switch, so that a command issued from said microcomputer in response to said stop input signal is cut off to stop said motor.

6. A method as set forth in claim 5, wherein in the steps (b) and (d), said coincidence switch is inserted into a signal line in series therewith, the signal line being connected to an input/output port of the microcomputer.

7. A method as set forth in claim 6, wherein in the steps (a) and (c), the command to start and stop the motor is selectively issued when the loom is to be started and stopped during a weaving operation; and a command to stop the motor is also issued when an abnormality, such as breakage of yarn, occurs in the loom.

8. Apparatus for controlling a motor which responds to start and stop signals generated on at least one signal line by a microcomputer to operate a loom, said apparatus comprising:

switching means connected in series with said signal line so that (i) said motor may start and stop in response to said start and stop signals only when said switching means is energized, and (ii) said motor will stop when said switching means is de-energized;

a manually actuable start switch;

a manually operable stop switch;

control means responsive to actuation of said start switch to energize said switching means and to maintain the energization thereof until said stop switch is actuated, to enable said motor to start in response to a start signal from said microcomputer, said control means being responsive to actuation of said stop switch to de-energize said switching means to cause said motor to stop, wherein false starts and failures to stop due to the effects of noise on said microcomputer may be prevented.

9. The apparatus according to claim 8, wherein:

said start switch is connected to said microcomputer to apply a start command thereto at substantially the same time said switching means is energized; and said stop switch is connected to said microcomputer to apply a stop command thereto at substantially the same time said switching means is de-energized.

* * * * *